US006317084B1

(12) United States Patent
Chen et al.

(10) Patent No.: US 6,317,084 B1
(45) Date of Patent: Nov. 13, 2001

(54) BROADBAND PLATE ANTENNA

(75) Inventors: Zhi Ning Chen; Michael Yan Wah Chia, both of Singapore (SG)

(73) Assignee: The National University of Singapore, Singapore (SG)

( * ) Notice: Subject to any disclaimer, the term of this patent is extended or adjusted under 35 U.S.C. 154(b) by 0 days.

(21) Appl. No.: 09/608,083

(22) Filed: Jun. 30, 2000

(51) Int. Cl.[7] ..... H01Q 1/38
(52) U.S. Cl. ..... 343/700 MS; 343/850
(58) Field of Search ..... 343/700 MS, 850

(56) References Cited

U.S. PATENT DOCUMENTS

| | | | | |
|---|---|---|---|---|
| 4,191,959 | * | 3/1980 | Kerr | 343/700 MS |
| 4,605,933 | | 8/1986 | Butscher | 343/700 |
| 4,835,539 | | 5/1989 | Paschen | 343/700 |
| 5,453,754 | * | 9/1995 | Fray | 343/789 |
| 5,764,190 | * | 6/1998 | Murch et al. | 343/702 |

OTHER PUBLICATIONS

Single–layer single–patch wideband microstrip antenna, T. Huynh et al., Electronics Letters 3rd Aug. 1995, vol. 31, No. 16, pp. 1310–1312.

Rectangular Patch Antenna with Broad Bandwidth, Zhi Ning Chen et al., p. 351.

Probe Compensation in Thick Microstrip Patches, P.S. Hall, 6th Apr. 1987, Electronics Letters 21st May 1987, vol. 23, No. 11, pp. 606–607.

A Wide–Band Single–Layer Patch Antenna, Naftali Herscovici, IEEE Transactions On Antennas And Propagation, vol. 46. No. 4, Apr. 1998.

Broadband microstrip patch antenna, K. M. Luk et al., Electronics Letters 23rd Jul. 1998, vol. 34, No. 15, pp. 1442–1443.

Tuning Stubs for Microstrip–Patch Antennas, M. du Plessis et al., IEEE Antennas and Propagation Magazine, vol. 36, No. 6, Dec. 1994, pp. 52–55.

Tunable Dual And Triple Frequency Stub Loaded Rectangular Microstrip Antennas, Asha E. Daniel et al., 0–7803–2719 5/95/$4.00@1995 IEEE, pp. 2140–2143.

Rectangular Microstrip Antennas For Stub Along The Non–Radiating Edge For Dual Band Operation, Asha E. Daniel et al., 0–7803–2719–5/95/$4.00@1995 IEEE, pp. 2136–2139.

Tuning Stubs for Microstrip Patch Antennas, M. Du Plessis et al., 0–7803–1246–5/93/$3.00 ©1993 IEEE, pp. 964–967.

Suspended Three–Dimensional Microstrip Radiators, N. Herscovici, U.S. Patent application Ser. No. 08/669,047, filed Apr. 1995.

* cited by examiner

*Primary Examiner*—Don Wong
*Assistant Examiner*—James Clinger
(74) *Attorney, Agent, or Firm*—Conley, Rose & Tayon, P.C.

(57) ABSTRACT

A broadband plate antenna (402) is disclosed, which includes a ground conductor (407) and a radiating element (406) which is separated from the ground conductor (407). The antenna also includes an impedance matching stub (404) electrically coupled to the radiating element (406), and means for feeding the radiating element (406), wherein the means for feeding includes a feed point (410) disposed on the impedance matching stub (404).

2 Claims, 7 Drawing Sheets

FIG. 1A – PRIOR ART
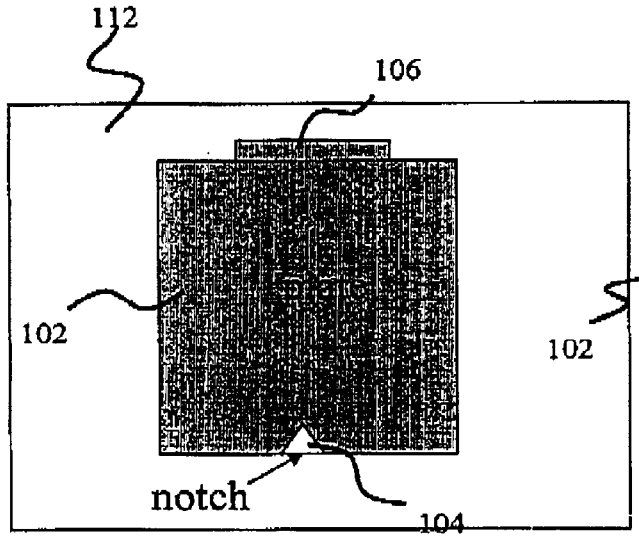
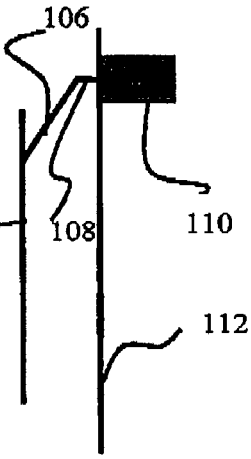
FIG. 1B – PRIOR ART
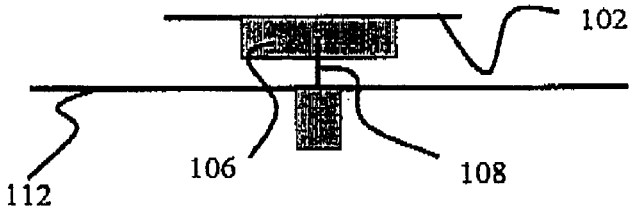
FIG. 1C – PRIOR ART

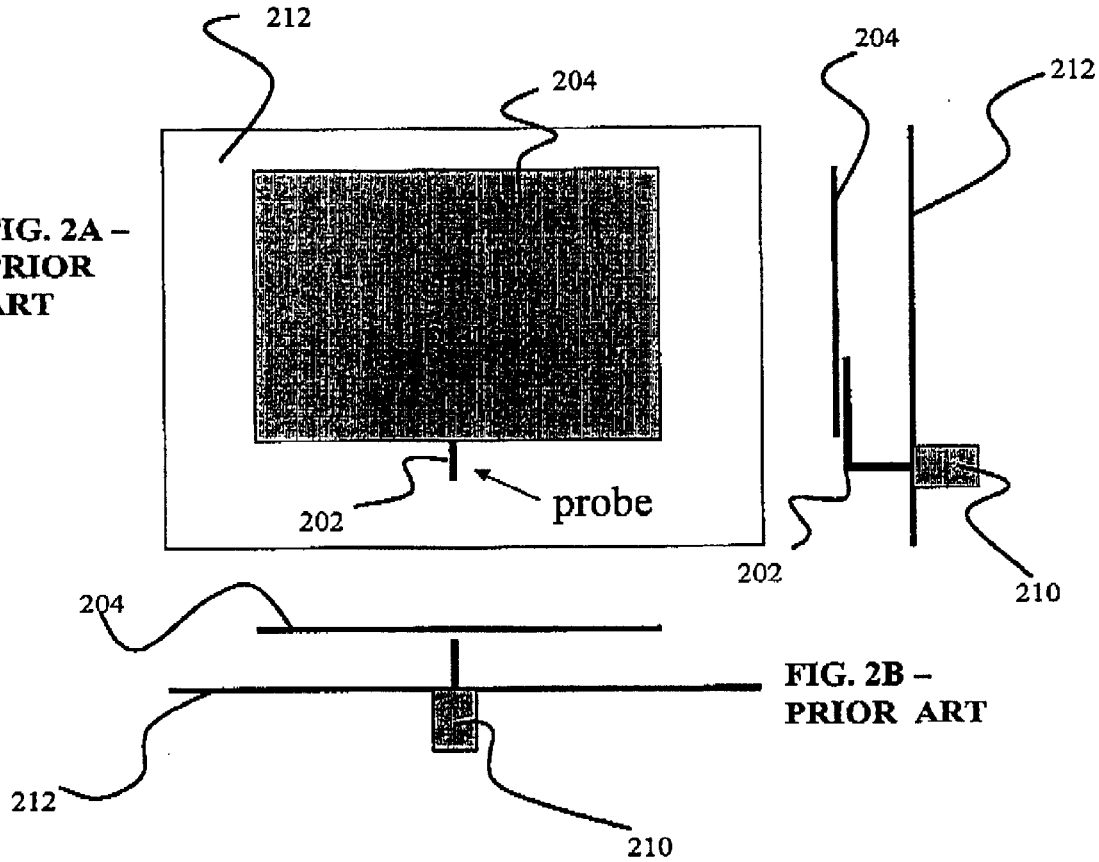
FIG. 2A – PRIOR ART
FIG. 2B – PRIOR ART
FIG. 2C – PRIOR ART

FIG. 3A – PRIOR ART
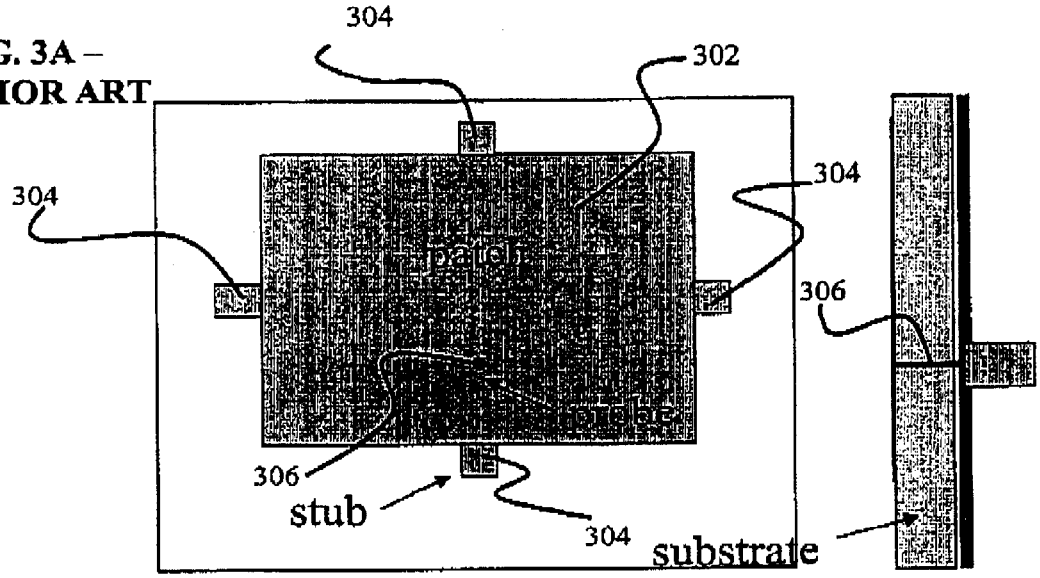
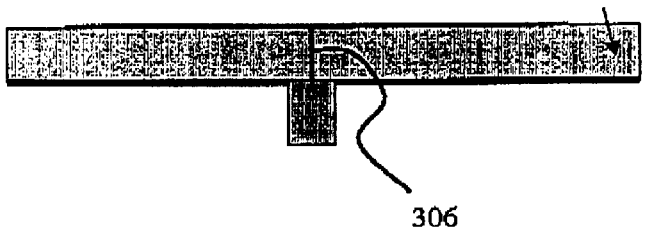
FIG. 3B – PRIOR ART
FIG. 3C – PRIOR ART

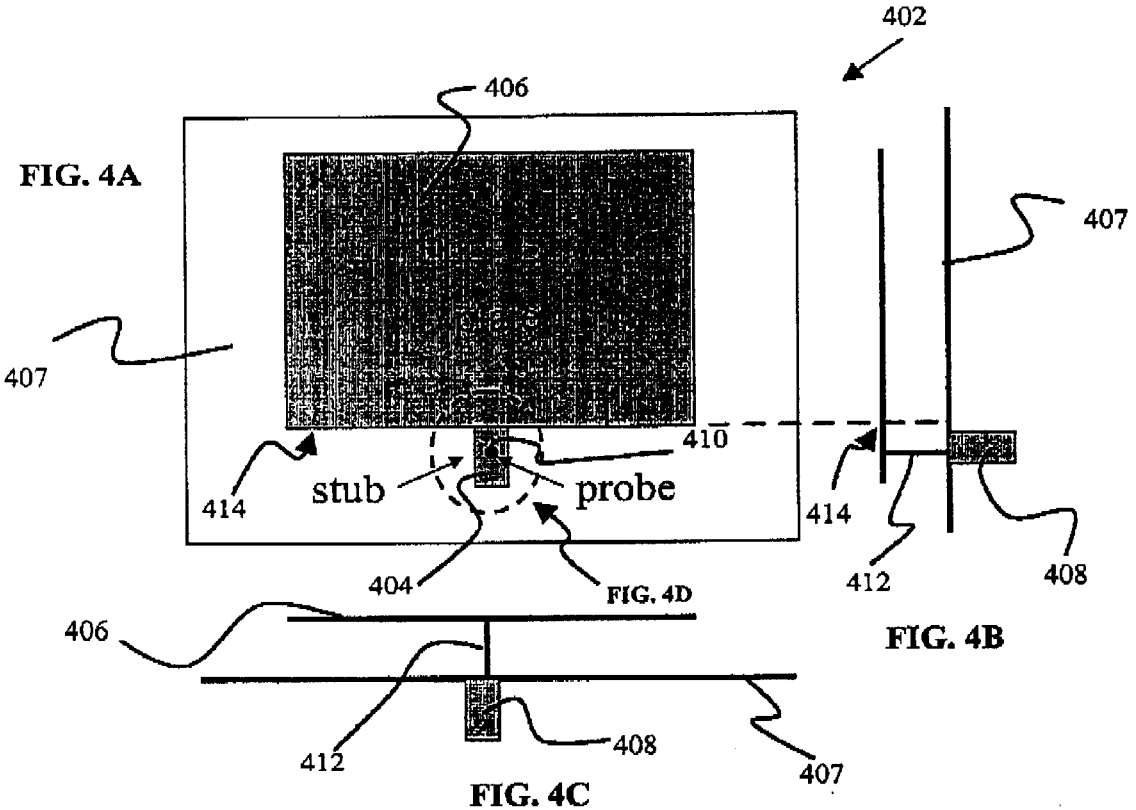
FIG. 4A
FIG. 4B
FIG. 4C
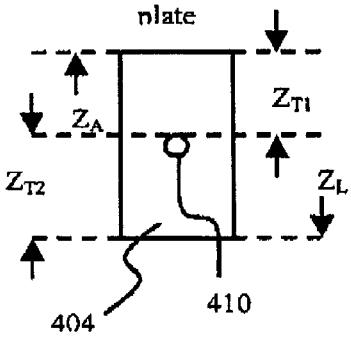
FIG. 4D
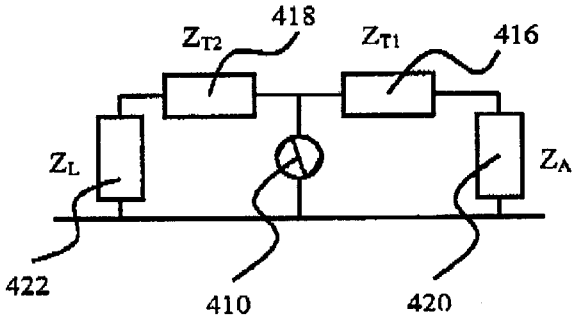
FIG. 4E

FIG. 5A
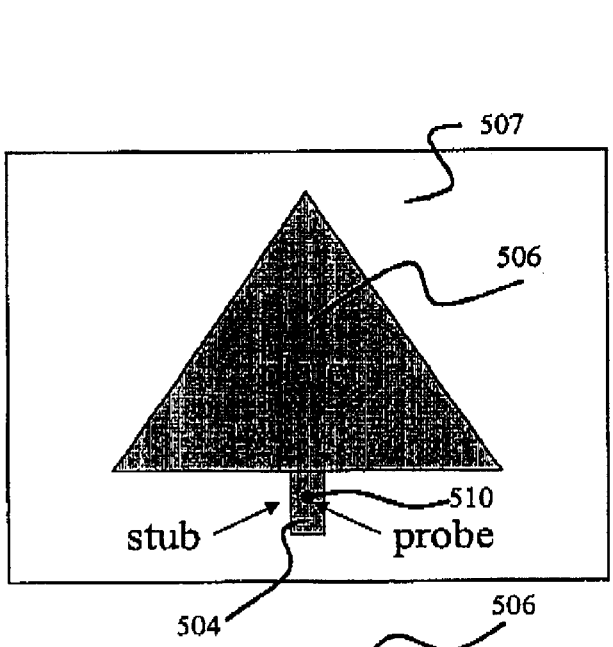
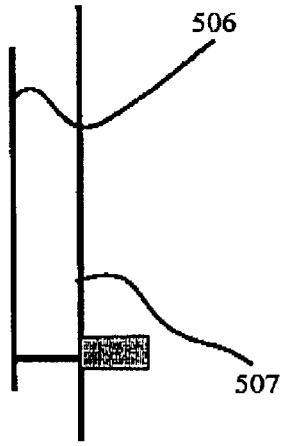
FIG. 5B
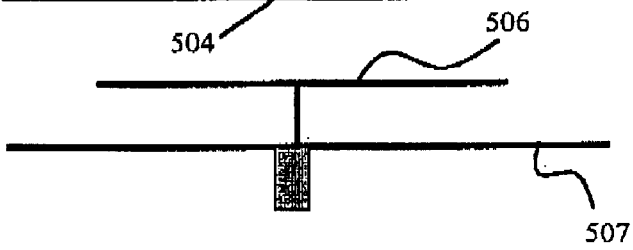
FIG. 5C

FIG. 6A
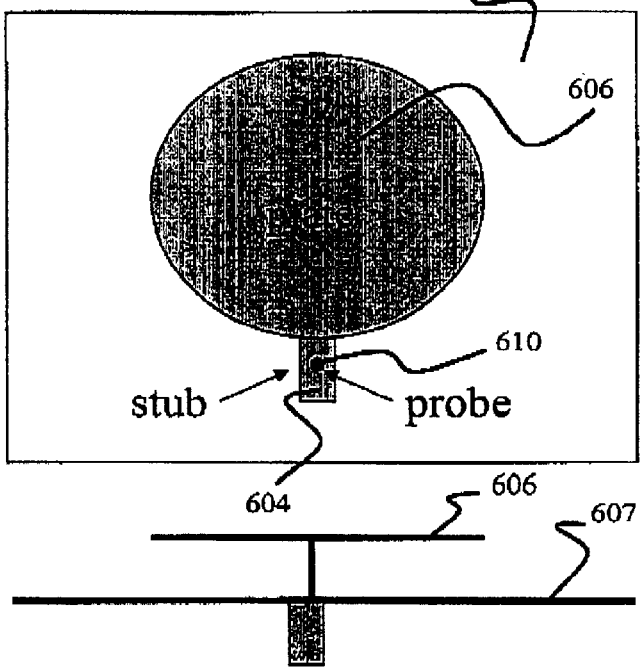
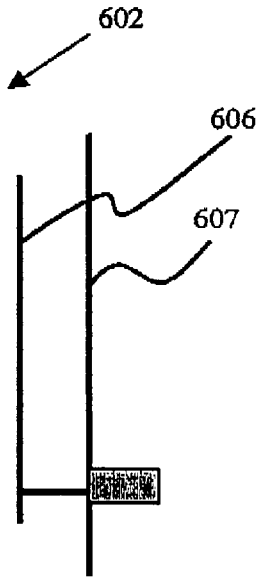
FIG. 6B
FIG. 6C 706
706A
706A
707
714
stub
probe
710
704
702
706
707
714
704
712
708

704
706
708
712
707

BROADBAND PLATE ANTENNA

FIELD OF INVENTION

The invention relates generally to antennas. In particular, the invention relates to a broadband plate antenna.

BACKGROUND

During the past several decades, investigative efforts for developing planar antennas have been expended because this class of antennas has inherent merits such as low cost of manufacture, ease of manufacture, compactness, and lightweight. These antennas in being planar and having low profiles are thus suitable for many industrial or military applications where the size and shape of antennas are crucial. This holds true especially for antenna array applications. However, the planar antenna as a resonant structure seriously suffers from the problem of having a narrow impedance bandwidth. Therefore, many proposals have been developed in an attempt to alleviate the narrow impedance bandwidth problem.

A microstrip patch antenna forms one type of planar antennas, where a conducting metal plate known as a patch is separated from a ground plane by a dielectric to form parallel planes. Patch antennas are attractive because of inherent characteristics such as low cost of manufacture, conformability, and ease of manufacture. However, a major limitation in the implementation of this type of antennas in various applications lies in the inherently narrow impedance bandwidth achieved, which is typically only in the order of a few percent when such antenna patches operate as radiators. For practical applications of antennas, a wide impedance bandwidth is generally required. On account of this fact, several techniques have been proposed to increase the impedance bandwidth of patch antennas. For a patch antenna having a single patch radiator, techniques involving the addition of a parasitic patch, the use of electrically thick substrate, and the cutting of a thin slot in the patch radiator have been proposed.

A parasitic patch increases the patch antenna volume substantially and is complicated to implement in an array design involving patch antennas. As to the method of using an electrically thick substrate in a patch antenna, the problem arising from using a long probe as a feed to the patch radiator has to be taken into account. The large inductance stemming from the long probe limits the achieved impedance bandwidth to less than 10%. In addition, undesired surface waves resulting from antenna operation decrease the radiation efficiency of the patch radiator significantly. By cutting a small circular slot to introduce capacitance or adding other capacitive components around the long probe or between the long probe and the patch radiator, an impedance bandwidth of 10% is obtainable. With the introduction of a U- or L-shaped slot, a substantial increase in impedance bandwidth of more than 20% is achievable. The impedance bandwidth of this kind of slotted patch radiator, however, is sensitive to the dimensions and locations of the slots.

As a variation to the patch antenna with electrically thick substrate, a patch antenna suspended above a ground plane has also been proposed. In this proposal, however, there is a tradeoff between the size and complexity of the antenna, and the impedance bandwidth of the patch antenna. By significantly enlarging the size and complicating the design of such a patch antenna, the impedance bandwidth may reach 65%. The spacing between the patch and the ground plate ranges from 0.14 $\lambda$ to 0.27 $\lambda$ ($\lambda$ is the operating wavelength) and the area of the patch also ranges from $0.39\times0.36\ \lambda^2$ to $0.70\times0.76\ \lambda^2$. Additionally, the dimensions of a finite-size copper plate used to approximate an infinitely ground plane ranges from $0.75\times0.56\ \lambda^2$ to $1.46\times1.10\ \lambda^2$. To alleviate this tradeoff, there is a further proposal to use an L-shaped probe as a feed for reducing the spacing between the patch and the ground plane, which ranges from 0.08 $\lambda$ to 0.15 $\lambda$. However, the achievable impedance bandwidth is approximately 30%.

In yet further proposal, a stub is applied to a patch antenna where the stub is used specifically for tuning the resonant frequency for antenna operation and for matching the patch antenna. In this proposal, the stub is applied to the patch antenna for dual or triple band operations with narrow impedance bandwidths.

There are a number of proposals which have been disclosed in patents in which the impedance bandwidths of proposed patch antennas have been extended. By using matching devices in one such proposal, the impedance bandwidth of a suspended patch antenna reaches 20%. Based upon the use of a parallel Resistance Capacitance Inductance (RCL) model in another such proposal, the design of a broadband patch antenna having series lumped capacitive devices is achievable. By tilting a radiating patch at an angle, the impedance bandwidth of another further proposed patch antenna is approximately 10%.

In proposals disclosed in patents for broadening impedance bandwidths of patch antennas, various techniques are used. A proposal described in U.S. Pat. No. 4,605,933, issued to The United States of America as represented by the Secretary of the Navy on Aug. 12, 1986, involves a large spacing (0.1~0.25 $\lambda$) between a radiator and a ground plane essentially for achieving an extended impedance bandwidth. However, matching devices must be introduced to the proposed antenna structure. Additionally, a non-planar ground plane is utilised, which is not suitable for array applications.

Similarly, having a complicated mechanical structure also poses a problem for a patch antenna as described in U.S. Pat. No. 4,835,539 issued to Ball Corporation on May 30, 1989. The use of lumped capacitive devices greatly increases manufacture cost therein. Furthermore, this type of proposed antenna structure is not suitable for array applications.

The approximately 10% impedance bandwidth achievable by a patch antenna described in U.S. Pat. No. 5,734,350, issued to Xertex Technologies, Inc. on Mar. 31, 1998, does not generally satisfy the requirement for wide impedance bandwidth in practice industrial applications. Additionally, a tilted plate implemented in the proposed antenna structure is not easily fabricated and mounted for array applications.

U.S. Pat. No. 5,874,919 issued to Harris Corporation on Feb. 23, 1999 describes a stub proposed for use as a tuning element for an active stacked patch antenna. This impedance bandwidth broadening technique disclosed mainly depends on both proximate feeding and stacked elements rather than the attached stub.

Among proposals for increasing the impedance bandwidth of a planar antenna, there are proposals for achieving broad impedance bandwidths using plate antennas. In these proposals, plate antenna broadbanding methods are employed for purposes of realizing the broad impedance bandwidth of a planar structure. However, these proposed planar antennas have complicated mechanical structures, which therefore adversely offset to a great extent the advantage gained in having broad impedance bandwidths.

One such planar antenna is described in U.S. patent application Ser. No. 08/669,047, where a radiator plate 102 with a special shape notch 104 and to which is attached a slant parasitic sheet 106 on the plate bottom as shown in FIG. 1. The proposed mechanical structure is complicated in respect of the design and adjustment process for such an antenna. Furthermore, the radiator 102 is completely suspended and a coaxial probe 108 (for example from a commercial service mount adapter (SMA) connector 110) is used for feeding the radiator 102 through the slant parasitic sheet 106. This kind of antenna is difficult to fabricate and assemble.

Another such planar antenna is proposed and disclosed in an article"Broadband Microstrip Antenna" by Luk et al. (Electron., Lett., Vol. 34, No. 15, PP. 1442–1443, 1998). The design of such a proposed antenna, as shown in FIG. 2, suffers from drawbacks such as complexity of mechanical structure, particularly in the implementation of an L-probe 202 which is spaced apart from a radiator 204, resulting in manufacture, adjustment and installation difficulties. Consequently, the complicated proposed mechanical structure undesirably increases the manufacture cost.

In the other proposals for achieving broad impedance bandwidths for planar antennas, one such proposal for a planar antenna being shown in FIG. 3, stubs are applied to patch antennas having narrow impedance bandwidth. The stubs provide specific load matching functions. As proposed in an article "Tuning Stubs for Microstrip-Patch Antennas" by M. Plessis and J. H. Cloete (IEEE Antennas and Propagation Magazine, Vol. 36, No. 6, PP. 52–55, 1994), and shown in FIG. 3, a radiator 302 has stubs 304 extending from the peripheries, and a coaxial probe 306 for feeding the radiator 302. The coaxial probe 306 directly contacts the radiator 302.

There is therefore a need for a low profile, cost effective and easily manufactured planar antenna having extended impedance bandwidth.

SUMMARY

In accordance with a first aspect of the invention, a broadband plate antenna is provided, which includes a ground conductor and a radiating element which is separated from the ground conductor. The antenna also includes an impedance matching stub electrically coupled to the radiating element, and means for feeding the radiating element, wherein the means for feeding includes a feed point disposed on the impedance matching stub.

The radiating element and ground conductor are preferably substantially planar and disposed substantially in parallel with each other.

Preferably, means for feeding the radiating element further includes a feedthrough disposed on the ground conductor and a probe, the probe extending through the feedthrough and electrically coupling with the feed point.

The antenna also preferably further includes a dielectric material for separating the radiating element and ground conductor.

Preferably, the radiating element includes a radiating edge, the impedance matching stub extending from the radiating edge and being unitary with the radiating element. Each of the radiating element and impedance matching stub is substantially planar, and substantially co-planar with the other. The impedance matching stub is substantially rectangular and the feed point is located at the center-point of the width of the impedance matching stub. The radiating element is substantially rectangular.

The radiating element preferably includes a pair of slots, each of the pair of slots being symmetrically located on each side of the longitudinal axis of symmetry of the radiating element. A portion of the impedance matching stub is disposed substantially separated from and in parallel with the radiating element, the portion of the impedance matching stub being positioned between the radiating element and the ground conductor.

The radiating element is preferably capable of operating in cavity mode and the impedance matching stub is designed according to transmission-line theory for providing reactive loading.

The radiating element and impedance matching stub are preferably designed by applying integrated design thereof according to transmission-line theory for achieving broadband matching.

In accordance with a second aspect of the invention, a method for configuring a broadband plate antenna having a ground conductor and a radiating element is provided. The method includes the steps of separating the radiating element from the ground conductor and designing an impedance matching stub according to transmission-like theory, and electrically coupling the impedance matching stub to the radiating element. The method further includes the steps of feeding the radiating element through a feed point which is disposed on the impedance matching stub.

Preferably, the step of electrically coupling the impedance matching stub to the radiating element includes the step of electrically coupling the impedance matching stub to the radiating element along a radiating edge thereof. The step of feeding the radiating element includes the step of locating the feed point at the center-point of the width of the impedance matching stub which is rectangular. The step of locating the feed point at the center-point of the width of the impedance matching stub includes the step of electrically coupling the impedance matching stub to the radiating element which is rectangular.

Preferably, the step of electrically coupling the impedance matching stub to the radiating element includes the step of extending the impedance matching stub being substantially planar from the radiating element being substantially planar, the radiating element and impedance matching stub being unitary. The step of separating the planar radiating element from the ground conductor includes the step of separating in parallel the planar radiating element from the ground conductor being substantially planar.

Preferably, the method includes the step of providing the radiating element with a pair of slots, each of the pair of slots being symmetrically located on each side of the longitudinal axis of symmetry of the radiating element. The step of electrically coupling the impedance matching stub to the radiating element includes the step of disposing a portion of the impedance matching stub substantially separated from and in parallel with the radiating element, the portion of the impedance matching stub being positioned between the radiating element and the ground conductor.

The step of separating the radiating element from the ground conductor preferably includes the step of separating the radiating element from the ground conductor with a dielectric material.

Preferably the method further includes the step of designing the radiating element for operation in cavity mode.

The step of designing an impedance matching stub according to the transmission-line theory preferably includes the step of designing the radiating element and impedance matching stub by applying integrated design thereof according to transmission-line theory for achieving broadband matching.

In accordance with a third aspect of the invention, a method for designing a broadband plate antenna having a radiating element and a ground conductor is provided. The method includes the steps of determining dimensions of the radiating element and determining the input impedance of the radiating element when the input reactance thereof is set approximately to zero and the resonance frequency thereof is set at an operating frequency. The method further includes the steps of designing an impedance matching stub as a transmission-line impedance transformer according to transmission-line theory, coupling electrically the impedance matching stub to the radiating element along a radiating edge thereof, and disposing a feed point on the impedance matching stub, a probe being electrically coupled to the feed point for feeding signals to the radiating element.

Preferably, the step of disposing a feed point on the impedance matching stub includes the step of initially locating the feed point at an end of the impedance matching stub distal to the radiating edge.

The step of disposing a feed point on the impedance matching stub preferably further includes the steps of adjusting the size of the impedance matching stub, and relocating the feed point towards an end of the impedance matching stub proximal to the radiating edge for achieving a good matching condition.

Preferably, the method further includes the step of extending the impedance matching stub being substantially planar and rectangular from the radiating element being substantially planar and rectangular, the radiating element and impedance matching stub being co-planar and unitary.

BRIEF DESCRIPTION OF THE DRAWINGS

Embodiments of the invention are described hereinafter with reference to the drawings, in which:

FIGS. 1A, 1B, and 1C are front, side, and bottom elevations, respectively, of a first conventional planar antenna;

FIGS. 2A, 2B, and 2C are front, side, and bottom elevations, respectively, of a second conventional planar antenna;

FIGS. 3A, 3B, and 3C are front, side, and bottom elevations, respectively, of a third conventional planar antenna;

FIGS. 4A, 4B, and 4C are front, side, and bottom elevations, respectively, of a rectangular plate antenna according to a first embodiment of the invention; FIG. 4D is an expanded view of a portion of the rectangular plate antenna in FIG. 4A; and FIG. 4E is an electrical representation of the portion of the rectangular plate antenna in FIG. 4D;

FIGS. 5A, 5B, and 5C are front, side, and bottom elevations, respectively, of a triangular plate antenna according to a second embodiment of the invention;

FIGS. 6A, 6B, and 6C are front, side, and bottom elevations, respectively, of a circular plate antenna according to a third embodiment of the invention.

DETAILED DESCRIPTION

Figures 7A, 7B, 7C:
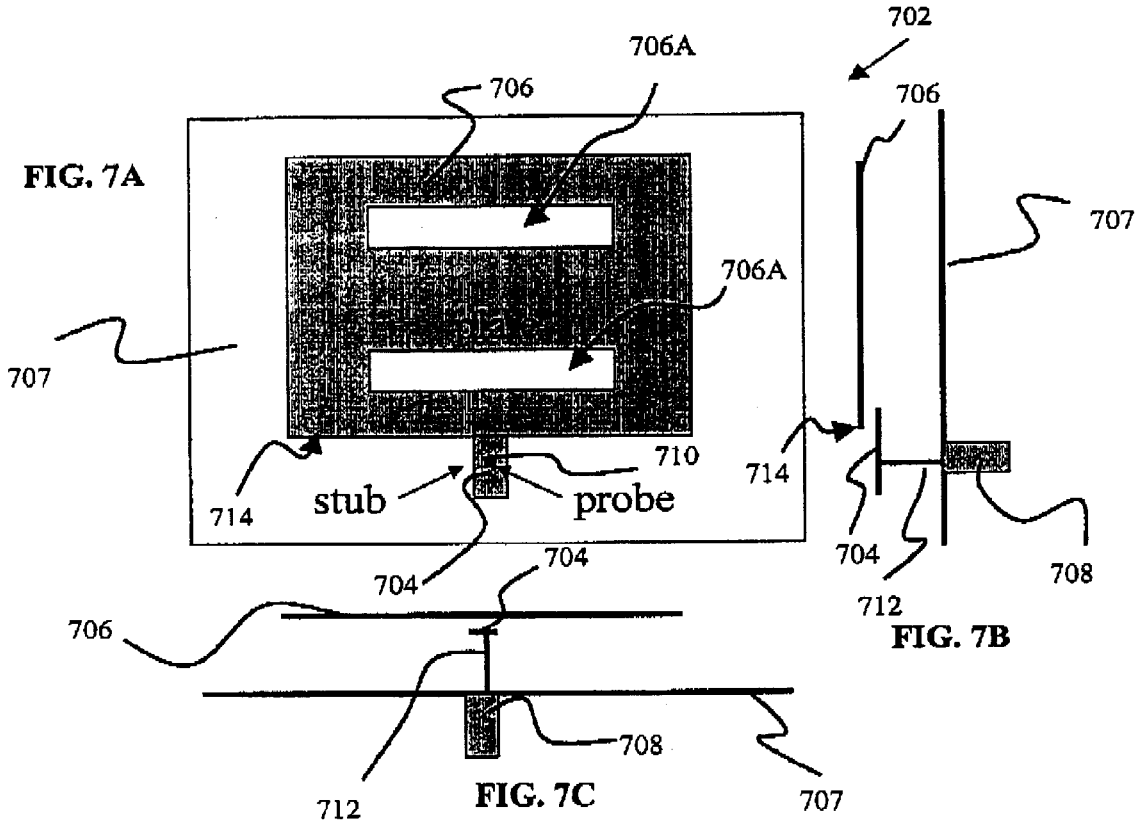
FIGS. 7A, 7B, and 7C are front, side and bottom elevations, respectively, of a rectangular plate antenna having symmetrical slots according to a fourth embodiment of the invention.

A type of planar antenna known as a microstrip patch antenna (hereinafter generally referred to as a plate antenna) having a configuration which includes the use of a stub, and a method for designing such a plate antenna are described hereinafter. The plate antenna provides a broad impedance bandwidth typically ranging from 20% to 30% for a 2:1 voltage standing wave ratio (VSWR). This type of planar antenna provides a low profile, cost effective and easily manufactured planar antenna having extended impedance bandwidth.

Essentially, each plate antenna operates with a reactive loading, thereby achieving a broad impedance bandwidth typically of the order of 20%. To this end, a stub is attached to a plate radiator (patch) which acts as a planar reactive loading to cancel the large reactance stemming from the longer probe. The stub functions not only as a tuning element for the plate antenna but also as a reactive element.

The geometry of a rectangular probe-fed plate antenna in accordance with a first embodiment of the invention is shown in FIGS. 4A, 4B and 4C. Plate antennas with other geometrically shaped patch radiators, namely triangular and circular, are shown in FIGS. 5A–5C and 6A–6C in accordance with second and third embodiments, respectively. The patch radiators of these plate antennas are preferably electrically thin and made of conductive plates. Additionally, such patch radiators are supported in such manner as to remain separated from and parallel to the ground plane. The patch radiator may be separated from the ground plane by air, foam or any other dielectric material with low permittivity and low loss characteristics. The stub in each case is an electrically narrow conducting stub and is attached to the radiating edge of the patch radiator. A 50Ω-coaxial probe feeds each plate antenna through the stub.

The patch radiator may also be shaped according to other geometric shapes such as an annular ring or other variations of the rectangular, triangular, or circular shapes. Also, the plate antenna may comprise a single patch radiator or a stack of patch radiators. The plate antenna may also have parasitic elements.

The plate antennas may be used to form an antenna array fed by probes, strip-lines or aperture-couplings.

There are manifold advantages in relation to such plate antennas. One advantage lies in the implementation of the patch radiator and stub with feed point structure, which leads to the cancellation of the large capacitance stemming from a long probe thereby resulting in a broad impedance bandwidth of the order of 20%.

Another advantage lies in the use of the stub as tuning and radiating elements for the plate antenna for realising patch antenna mode, or more clearly cavity mode, in addition to providing good matching. This enables the plate antenna to have a simple structure, which is suitable for easy manufacture and simple connection.

Further advantages in relation to the manufacture of the plate antenna are also attendant. Due to the simplicity of the design for the patch radiator and stub with feed point structure, a simple manufacturing process involving low material cost is achievable. For example, the plate antenna can be easily mounted and adjusted during manufacturing, with much flexibility.

Still further advantages in relation to the application of the plate antenna are apparent. The plate antenna has a low profile and is able to provide high gain in operation. The plate antenna in operation is also able to provide a stable co-polarization radiation pattern and low cross-polarization levels.

The plate antenna is also easily connectable to other communication devices. For example, the plate antenna is easily fed with any probe or using any other feeding method such as aperture coupling.

The achieved impedance bandwidth involving the application of the plate antenna can be further broadened by stacking a patch above the patch radiator of the plate antenna and also adding parasitic elements around the patch radiator. By introducing short-pins to the patch radiator and reactive loading to the stub, the size of the plate antenna and the length of the stub are reduced.

Applications of the plate antenna include antenna arrays which are either fixed or mobile. Additionally, the plate antenna is suitable for application as a portable antenna for communication systems.

Table 1 contains data obtained from studies, measurements and simulations of the rectangular plate antenna shown in FIGS. 4A–4C and the conventional planar antennas shown in FIGS. 1A–1C and 2A–2C for purposes of performance comparison. All dimensions used in Table 1 are normalized by the wavelength at the highest operating frequency for a 2:1 VSWR. Similarly, the impedance bandwidths of the antennas are compared at a 2:1 VSWR.

TABLE 1

| Performance | First embodiment shown in FIG. 4 | Antenna shown in FIG. 1 | Antenna shown in FIG. 2 |
|---|---|---|---|
| Cost | Low | High | Medium |
| Manufacture | Easy | Hardest | Fair |
| Installation | Easy | Hardest | Hard |
| Flexibility | Easy | Hardest | Fair |
| Adjustment | Easy | Hardest | Hard |
| Profile (height λ) | 0.12 | 0.14 | 0.12 |
| Size(length × width, λ) | 0.62 × 0.47 | 0.70 × 0.76 | 0.55 × 0.45 |
| Impedence bandwidth, % | 32 | 65 | 36 |
| Gain, dBi | 4.5~9.1 | 2.9~8.1 | 5.2~7.5 |
| Co-polarisation | Stable | Unstable | Stable |
| X-polarisation, dB (E-, H-plane) | <−35, <−15 | <−25, <−10 | <−30, <−15 |

It is apparent from Table 1 that in relation to issues involving the manufacture of the planar antennas, the rectangular plate antenna compares favorably with the conventional planar antennas. The dimensional aspects of the rectangular plate antenna are also comparable with the convention planar antennas. Other electrical aspects of the planar antennas including the impedance bandwidth, gain, co-polarization, and cross-polarization are also comparable.

In the embodiments of FIGS. 4A–4C, 5A–5C, and 6A–6C, the method of introducing a reactive loading into a plate antenna for enhancing and broadening the impedance bandwidth is applied. This type of planar antennas is capable of providing at least 20% impedance bandwidth, covering the Personal Communication Network (PCN), Personal Communication Service (PCS), and Wide Code Division Multiple Access (W-CDMA) bands at less than 1.5 VSWR.

For purposes of brevity, only the structure of the first embodiment shown in FIGS. 4A–4C is described in detail. The structure of the second and third embodiments shown in FIGS. 5A–5C and 6A–6C, respectively, in general include parts or features that are have similar geometric shapes with parts or features in the first embodiment, excepting the shapes of the patch radiators 406, 506 and 606. Such similarly shaped parts or features in the second and third embodiments are therefore designated by reference numerals that correspond to reference numerals designating the corresponding parts or features of the first embodiment. In the rectangular plate antenna (generally designated by the reference numeral 402) shown in FIGS. 4A–4C, an electrically narrow stub 404 is introduced as not only a tuning element for the rectangular plate antenna 402 but also as a reactive load. By implementing the rectangular plate antenna 402 with the stub 404 and feeding the rectangular plate antenna 402 through the stub 404, a broadband plate antenna having a simple mechanical structure is therefore achieved. In the case of the rectangular plate antenna 402, the stub 404 extends from the rectangular-shaped patch radiator 406. In the other embodiments of triangular and circular plate antennas 502 and 602 shown in FIGS. 5A–5C and 6A–6C, respectively, the triangular-and circular-shaped patch radiators 506 and 606, respectively, are used. In comparison with the conventional planar antennas indicated in Table 1, the rectangular plate antenna 402 further has the advantages of being structurally simple and easy to adjust and manufacture, while at the same time retaining all the electrical advantages of the conventional planar antennas.

The patch radiator 406 preferably consists of a piece of suitable conductive metal plate without attachment to any dielectric substrate or superstrate. A ground plane 407 lies in parallel with and is spaced apart from the patch radiator 406. The patch radiator 406 is disposed in relation to the ground plane 407 in a manner so that the orthogonal projection of the patch radiator 406 on the ground plane 407 lies substantially within the borders of the ground plane 407. Preferably, a commercial 50Ω-SMA connector 408 is used for feeding the rectangular plate antenna 402.

The patch radiator 406 functions as a planar radiating element and is fed with signals through a feed point 410 on the stub 404 by a coaxial probe 412 extending from the SMA connector 408 through a feedthrough in the ground plane 407. The coaxial probe 412 is the extended inner conductor of the SMA connector 408. The ground point of the SMA connector 408 is connected to the ground plane 407 in the proximity of the feedthrough.

The electrically thin stub 404 preferably extends centrally from a radiating edge 414 of the patch radiator 406 as part of a unitary coplanar conducting plate. By providing such a structure, the manufacturing material cost of the rectangular plate antenna 402, as well as that of the triangular and circular plate antennas 502 and 602, is kept very low. The rectangular plate 402 is also easily manufactured and mounted because of structural simplicity. For purposes of providing flexibility in applications, many shapes can be chosen for a patch radiator, for instance, rectangular, square, triangular, circular, annular, or other variations of these shapes.

The dimensions of the patch radiator 406 are first determined according to rules known to those skilled in the art on designing a conventional rectangular patch antenna. Then, any variations to the dimensions, and hence to the impedance, of the rectangular plate antenna 402 can be compensated by the adjustment to the size of the stub 404 and the feed point 410 location. The profile of the rectangular plate antenna 402 can be kept low because the rectangular patch antenna 402 operates in cavity mode, wherein the operation of such a mode typically requires a resonant structure with a profile which is low. By having the coaxial probe 412 being directly attached to the stub 404, there is also provided a reference for the adjustment and fixing of the spacing between the radiator patch 406 and the ground plane 407.

The details of the method for designing the rectangular plate antenna 402, are the like plate antennas, and the bases for developing such a method are described hereinafter. A scenario where the stub 404 is not implemented on the rectangular plate antenna 402 is first considered. By increasing the spacing between the radiator patch 406 and the ground plane 407, the input impedance of the rectangular plate antenna 402 increases. Therefore in order to achieve a good match, the feed point 410 must be located away from the centre of the radiator patch 406 near the radiating edge 414. When the spacing increases to approximately 0.05 times the central operating wavelength, the feed point 410 is located at the radiating edge 414. However, this still does not allow for a good match.

Therefore, the stub 404 is necessarily implemented on the rectangular plate antenna 402 in the current scenario for achieving a good matching condition and therefore a broad impedance bandwidth for the rectangular plate antenna 402. The stub 404 is designed based on transmission-line theory and attached to the radiating edge 414 and the feed point 410 is located on the stub 404 for providing a good match.

The method for designing the rectangular plate antenna 402 and the like plate antennas requires the initial determination of the dimensions of the rectangular patch radiator 406, or the triangular or circular radiator patch 506 or 606, respectively, as the case may be, according to rules known to those skilled in the art on designing a conventional patch antenna. Next, the input impedance $Z_A$, as shown in FIG. 4D, of the radiator patch 406 is determined, with the input reactance set approximately to zero and the resonance frequency set at the operating frequency of interest. After estimating the input impedance $Z_A$, the stub 404 is designed as a transmission-line impedance transformer based on transmission-line theory. The stub 404 is subsequently electrically attached to the radiating edge 414 of the patch radiator 406, and the coaxial probe 412 is electrically connected to the feed point 410 which is located at the end of the stub 404 distal to the radiating edge 414. Adjustment to the size of the stub 404 is then done in addition to the relocation of the feed point 410, therefore resulting in also moving the position of the coaxial probe 412 in relation to the stub 404, in the direction of the end of the stub 404 proximal to the radiating edge 414. This is for achieving a good matching condition and therefore a broad impedance bandwidth for the rectangular plate antenna 402.

With reference to FIGS. 4D and 4E an underlying principle for designing the stub 404 is described. Here the stub 404 may be considered as a T-impedance matching network when viewed from the feed point 410, in which the network consists of two parts with equivalent impedance $Z_{T1}$ 416 and $Z_{T2}$ 418. One part on the network $Z_{T1}$ 416 electrically connects to the input impedance $Z_A$ 420 of the rectangular patch radiator 406. The other part of the network $Z_{T2}$ 418 electrically connects to a loading impedance $Z_L$ 422 that is electrically representative of the end of the stub 404 distal to the radiating edge 414. By altering the location of the feed point 410 and any dimension of the stub 404, the equivalent impedances $Z_{T1}$ 416 and $Z_{T2}$ 418 change. Therefore based on network theory, by choosing proper values of equivalent impedances $Z_{T1}$ 416 and $Z_{T2}$ 418, good matching between the feed point 410 and all loading impedances may be achieved.

The patch radiator 406 is considered as a loading of the stub 404. The stub 404 converts the loading impedance to the output impedance of means for feeding the patch radiator 406, namely, the coaxial probe 412.

An alternative method for designing the rectangular plate antenna 402 and the like plate antennas involves the application of integrated design of the radiator patch 406 and the stub 404 using transmission-line theory for achieving broadband matching. The underlying principle of such a design method is based on the concept of designing the radiator patch 40 and the stub 404 as a whole using transmission-line theory.

By applying any of such design methods to the rectangular plate antenna 402, the following dimensions are achieved. The radiator patch 406 and the stub 404 are preferably electrically thin, for example, the thickness of both being at least 0.001 times the operating wavelength $\lambda$. The radiator patch 406 and the stub 404 are also preferably made of good conductive metals. The feed point 410 is preferably located at the center-point of the width of the stub 404 and at a distance of $0.061\lambda$ away from the radiating edge 414 of the radiator patch 406. Further geometric dimensions of the rectangular plate antenna 402 are listed in Table 2, which is shown hereinafter.

In relation to electrical performance measures such as broad impedance bandwidth, high gain, high efficiency (without any dielectric or surface wave loss), stable radiation pattern and acceptable cross-polarization level, the rectangular plate antenna 402 is comparable with the conventional planar antennas indicated in Table 1. For each antenna compared in Table 1, the cross-polarization level is relatively high, especially in the higher bands when the communication direction offsets the maximum radiation direction. The relatively higher cross-polarization level achieved by the rectangular plate antenna 502 inherently stems from the longer coaxial probe 412. With the same electrical sizes, the rectangular plate antenna 502 has the advantages of a higher gain and low cross-polarization level over the conventional planar antennas. A comparison of the data in Table 1 further demonstrates that the flexibility of the rectangular plate antenna 502 lies in the possibility of readily forming a stacked structure or a structure having parasitic elements with the rectangular plate antenna 502. The non-planar applications, for example, a conformal structure for use in an airplane fuselage, also are available.

Additionally, the data in Table 1 validates the advantages inherent in the implementation of the method of introducing a reactive loading by using a coplanar unitary conducting plate for forming the rectangular radiator patch 406 and the adjustable stub 404.

For the rectangular plate antenna 402, measurements on the VSWR, input impedance and radiation pattern have been conducted and studied, with have good agreements except for approximately 5% shift in the resonant frequency. The measurements on VSWR, input impedance and radiation pattern of a further rectangular plate antenna (not shown in any FIGURE), and the triangular and circular plate antennas

502 and 602 are provided in Table 2. The dimensions and electrical performance of these plate antennas are also listed in Table 2. All dimensions in Table 2 are normalized by the wavelength at the highest operating frequency for a 2:1 VSWR.

TABLE 2

| Performance | Rectangular 1 | Rectangular 2 | Triangular | Circular |
|---|---|---|---|---|
| Size of plate, λ | 0.79 × 0.47 | 0.62 × 0.47 | 0.60 | 0.29 (radius) |
| Size of stub, λ | 0.23 × 0.13 | 0.43 × 0.08 | 0.40 × 0.08 | 0.43 × 0.05 |
| Spacing, λ | 0.08 | 0.12 | 0.12 | 0.12 |
| Impedance bandwidth, % | 28 | 32 | 25 | 30 |
| Achieved gain, dBi | 4.8~9.9 | 4.5~9.1 | 2.4~8.5 | 5.2~8.9 |
| X-polarisation, dB | <−35, <−20 | <−35, <−15 | <−25, <−17* | <−40, <−35* |

*simulated data available only

With a boom in mobile communication services, there are many wide impedance bandwidth applications, especially in the ultra-high-frequency (UHF) band. The requirements for antenna impedance bandwidth in relation to the various mobile communication bands are listed in Table 3.

TABLE 3

| Wireless Communication Band | Frequency Range MHz | Required Impedance bandwidth for VSWR =1.5:1, % |
|---|---|---|
| AMPS | 824~894 | 8.2 |
| GSM | 880~965 | 9.3 |
| ISM (low) | 902~927 | 2.8 |
| PCN | 1710~1880 | 9.5 |
| PCS | 1850~1990 | 7.3 |
| W-CDMA | 1920~2170 | 12.3 |
| ISM (high) | 2400~2500 | 4 |

Notes:
APMC = Advanced Mobile Phone Service
GSM = Global System for Mobile communications
ISM = Industrial, Scientific and Medical
PCS = Personal Communication Service
PCN = Personal Communication Network
W-CDMA = Wide Code Division Multiple Access Table 3 indicates that the required impedance bandwidths are at least 10% for many UHF applications. Approximately 30% impedance bandwidth is also required for some communications systems. However, as for a typical planar antenna in a basic form, there is difficulty meeting this requirement. Various techniques for enhancing the impedance bandwidth of a planar antenna have been applied to antenna design and implementation and the achieved impedance bandwidths of some planar antennas have reached the order of 10%. However, these techniques also introduce complicated structures to the planar antenna, thereby resulting in high fabrication cost, large dimensions, low efficiency, and difficult adjustment and installation. By using a suspended plate antenna, there arise new possibilities of planar antenna design and application. At least 20% impedance bandwidths for planar antennas can be readily achieved. This implies the fact that the suspended plate antennas are capable of covering many impedance bandwidth requirements. Thus, for UHF applications, there are options which include the suspended plate antennas such as the plate antennas according to the embodiments of the invention or those conventional planar antennas indicated in Table 2. However, these plate antennas have more potential applicability in industries than the conventional planar antennas because these plate antennas possess the evident mechanical advantages over the conventional planar antennas, which lead to further significant reduction of the fabrication cost. As discussed in the foregoing, this reduction is attractive and important for industrial applications, especially for array applications. The relatively higher lever of cross-polarization, which is often useful in most mobile communication systems, is especially applicable to the design of the dual linear-polarised versions. When the electromagnetic environment is random, the higher cross-polarization can improve the quality of communications. The broadband plate antenna having patch and stub radiating elements formed from a coplanar unitary conducing plate may be applied to array applications, especially to the design of base station antenna.

In addition to the embodiments of the rectangular, triangular and circular plate antennas 402, 502 and 602 shown in FIGS. 4A–4C, 5A–5C and 6A–6C, respectively, a fourth embodiment shown in FIGS. 7A–7C is described. The fourth embodiment provides better X-polarisation results than the other embodiments.

In such an embodiment, a plate antenna 702 includes a slotted rectangular-shaped patch radiator 706, an electrically narrow stub 704 and a ground plane 707 being spaced apart from and in parallel with the slotted rectangular-shaped patch radiator 706. The slotted rectangular-shaped patch radiator 706 has a pair of rectangular slots 706A that are located symmetrically on each side of the longitudinal axis of symmetry of the rectangular-shaped patch radiator 706. Unlike the other forgoing embodiments, the stub 704 in this instance is not physically attached to or extended from the slotted rectangular-shaped patch radiator 706. The stub 704 instead is merely electrically connected to the slotted rectangular-shaped patch radiator 706 by way of disposing a portion of the stub 704 spaced apart from but in parallel with the slotted rectangular-shaped patch radiator 706. The plate antenna 704 is also configured in such a manner that the portion of the stub 704 is positioned between the slotted rectangular-shaped patch radiator 706 and the ground plane 707. The end of the portion of the stub 704 when viewed from the front elevation shown in FIG. 7A, also does not extend beyond the rectangular slot 706A proximal to a radiating edge 714, which in turn is proximal to the stub 704, of the slotted rectangular-shaped patch radiator 706.

Like the other embodiments, the slotted rectangular-shaped patch radiator 706 functions as a planar radiating element and is fed with signals, through the electrical connectivity between the stub 704 and the slotted rectangular-shaped patch radiator 706, via feed point 710 on the stub 704 by a coaxial probe 712 extending from a SMA connector 708 through a feedthrough in the ground plane 707.

In the foregoing manner, a cost-effective plate antenna with a simple structure for providing broadband antenna operation is disclosed. A number of embodiments are described. However, it will be apparent to one skilled in the art in view of this disclosure that numerous changes and/or modifications can be made without departing from the scope and spirit of the invention. For example, the patch radiator may be designed to have a shape other than standard geometric shapes such as those already discussed. Also, the patch radiator may not necessarily be planar. The ground conductor also need not be planar, and the patch radiator and the stub too need not be co-planar. Such variations to the plate antenna allow the flexible implementation thereof to suit profiles of housings within which the plate antenna may be disposed.

What is claimed is:

1. A method for designing a broadband plate antenna having a radiating element and a ground conductor, including the steps of:

determining dimensions of said radiating element;

determining the input resistance of said radiating element when the input reactance thereof is set approximately to zero and the resonance frequency thereof is set at an operating frequency;

designing an impedance matching stub as a transmission-line impedance transformer according to transmission-line theory;

coupling electrically said impedance matching stub to said radiating element along a radiating edge thereof; and disposing a feed point on said impedance matching stub, a probe being electrically coupled to said feed point for feeding signals to said radiating element, further including initially locating said feed point at an end of said impedance matching stub distal to said radiating edge, adjusting the size of said impedance matching stub; and relocating said feed point towards an end of said impedance matching stub proximal to said radiating edge for achieving a good matching condition.

2. The method in claim 1, further including the step of extending said impedance matching stub being substantially planar and rectangular from said radiating element being substantially planar and rectangular, said radiating element and impedance matching stub being co-planar and unitary.

* * * * *